US006994494B2

(12) United States Patent
Schmidmaier et al.

(10) Patent No.: US 6,994,494 B2
(45) Date of Patent: Feb. 7, 2006

(54) DEVICE FOR PRODUCING BORED PILES

(75) Inventors: Ludwig Schmidmaier, Pegnitz (DE); Wolfgang Harttig, Gröbenzell (DE)

(73) Assignee: Bauer Maschinen GmbH, Schrobenhausen (DE)

( * ) Notice: Subject to any disclaimer, the term of this patent is extended or adjusted under 35 U.S.C. 154(b) by 0 days.

(21) Appl. No.: 10/642,568

(22) Filed: Aug. 18, 2003

(65) Prior Publication Data

US 2004/0105728 A1 Jun. 3, 2004

(30) Foreign Application Priority Data

Aug. 21, 2002 (DE) ..... 102 38 082

(51) Int. Cl.
*E02D 7/28* (2006.01)
*E21B 17/22* (2006.01)

(52) U.S. Cl. ..... 405/232; 175/323; 175/394; 198/676; 241/260.1

(58) Field of Classification Search ..... 198/676, 198/690.2, 699.1; 241/260.1; 175/323, 175/394; 405/241, 231, 232
See application file for complete search history.

(56) References Cited

U.S. PATENT DOCUMENTS 220,132 A * 9/1879 Elliot ..... 175/388
1,650,103 A * 11/1927 Watchorn ..... 173/24
2,780,439 A * 2/1957 Kandle ..... 175/391
3,565,190 A * 2/1971 Ishii ..... 175/171
4,908,101 A * 3/1990 Frisk et al. ..... 162/261
5,516,237 A * 5/1996 Hebant ..... 405/233

FOREIGN PATENT DOCUMENTS

| | | | |
|---|---|---|---|
| CA | 967770 | * | 5/1975 |
| DE | 40 08 207 A1 | | 8/1990 |
| DE | 42 19 150 C1 | | 9/1993 |
| DE | 41 41 629 C2 | | 2/1997 |
| DE | 197 38 171 A1 | | 3/1999 |
| DE | 195 30 827 A1 | | 12/2000 |
| DE | 199 28 287 A1 | | 12/2000 |
| DE | 100 21 549 A1 | | 10/2001 |
| DE | 198 25 169 C2 | | 10/2003 |
| GB | 2355750 | * | 5/2001 |
| JP | 7-42469 | * | 8/1993 |
| JP | 08082186 | * | 3/1996 |
| JP | 2001-3363 | * | 1/2001 |

* cited by examiner

*Primary Examiner*—Sunil Singh
(74) *Attorney, Agent, or Firm*—Jacobson Holman PLLC

(57) ABSTRACT

Device for producing bored piles having an auger, which along at least part of the auger length is surrounded by a rotating encasing tube and during boring the encasing tube is rotated in or counter to the rotation direction of the auger and in which the auger and the encasing tube are introduced essentially simultaneously into the ground during boring. To facilitate material discharge, the surface roughness of the auger helix surface pointing in the feed direction is increased compared with the roughness of the rolled surfaces in a complete or partial surface manner by additional machining. The increase in the surface roughness extends at least over the auger length necessary for feed purposes.

11 Claims, 2 Drawing Sheets

DEVICE FOR PRODUCING BORED PILES

CROSS REFERENCE TO RELATED APPLICATIONS

Not applicable.

BACKGROUND OF THE INVENTION

1. Field of the Invention

The invention relates to a device for producing tubed, bored piles, in which during sinking simultaneously a tubing and an inner auger are introduced into the ground in a rotary boring method.

2. Description of Related Art

Numerous production methods exist for producing bores for bored piles.

If the soil is soft, displacement bored piles can be produced. In the case of loose soils and when ground water is close to the surface, use is generally made of tubed boreholes. For this purpose a tubing is turned into the ground and the soil cropping up within the tubing is removed by differing boring tools. If there is no ground water, in order to avoid a hydraulic soil movement during soil removal from the interior of the tube, water must be filled into the latter. This method is time-consuming due to the need of constantly topping up the water.

If the production output is to be improved, drilling takes place with a continuous soil auger in the case of gravelly and sandy soils with ground water, so that the auger is at least as long as the borehole is deep. The auger is turned into the ground and the auger helixes and the soil located thereon support the wall of the borehole. This has a comparable effect to the production of a tubed bore. On reaching the final depth the auger is retracted essentially without rotating the same and simultaneously concrete is introduced under pressure into the cavity formed through the auger core tube.

In some soils, where the bored pile must grip in firm soil layers or it is necessary to cut through cohesive or harder soil layers, untubed production of bored piles with a continuous auger is less suitable, because as a result thereof, during the boring through or gripping in the hard soil, more material than is needed is delivered from the loose soil layers.

In some cases it is then possible to use boring methods in which simultaneously a continuous auger and an encasing tubing are introduced into the ground. Both the auger and the encasing tube must be at least as long as the depth of the borehole to be produced. DE 197 38 171 A1 describes a device suitable for this.

Such methods are known as double or twin head boring. There are two drive units, which on the one hand drive the inner, continuous auger and simultaneously the outer tubing. As a function of the method the auger and the tubing are rotated in the same direction or in opposite directions. It is also appropriate at least over a short area to axially displace the inner auger against the outer tubing.

The concreting procedure in the case of double head boring is similar to that with a continuous soil auger. On retracting the tubing, including the inner auger, as a rule concrete is pumped into the resulting cavity via the core tube.

However, it is not always possible without problems to feed soil during the sinking of the tubing through the inner, continuous auger. If in the case of loose soils layers of cohesive soil material are encountered, this can give rise to problems in the feeding or delivery procedure. The cohesive soil becomes stuck in the auger, forms a plug and the material flow within the tubing is no longer ensured. The auger rotates on the spot without delivering material upwards.

As a result of the auger blockage, in the worst possible case a bore must be broken off and the entire tubing with the auger has to be extracted for cleaning purposes. The subsequent boring of the pile can give rise to disadvantages with respect to the support behaviour of said pile, because the surrounding soil has been excessively loosened.

Another problem arises on boring in coarse-grain soils. In such a case the material to be fed can jam between the auger and the inner wall of the tubing and only with very great force expenditure can the auger be turned in the interior of the tubing and only a small amount of soil is delivered. Thus, the boring tool can only penetrate the soil very slowly.

BRIEF SUMMARY OF THE INVENTION

The object of the device according to the invention, particularly when using the double head method, is to ensure blockages in the auger or ensures the delivery of the soil with reduced force expenditure and therefore in a faster and better manner.

This object is achieved by a device for producing bored piles having an auger, which along at least part of the auger length is surrounded by a rotating encasing tube and during boring the encasing tube is rotated in or counter to the rotation direction of the auger and in which the auger and the encasing tube are introduced essentially simultaneously into the ground during boring, characterized in that to facilitate material discharge, the surface roughness of the auger helix surface pointing in the feed direction is increased compared with the roughness of the rolled surfaces in a complete or partial surface manner by additional machining and that the increase in the surface roughness extends at least over the auger length necessary for feed purposes.

According to the prior art continuous or through augers are used, in which the auger helixes are produced from rolled plates a few centimetres thick. These rolled plates have a surface roughness, which can essentially be called smooth.

The surface roughness is essentially defined in the size of the height differences in the surface. In the case of conventional rolled plates the fluctuations in the surface height ranges up to approximately 50 $\mu$m and is essentially dependent on how much scale there is on the surface.

Experience has shown that in particular with smooth helix surfaces formed from conventional rolled plates the aforementioned difficulties arise. The turning or rotation of the auger in the interior of the tubing is very difficult and on the auger blockages occur on encountering cohesive soil layers.

As a function of the adhesion, cohesive soils adhere to a greater or lesser extent to the auger helix surface. However, in order to be able to feed vertically soil material by means of an auger with encasing tubing, it is necessary for the frictional force between the soil and the steel surface of the auger helix to be lower than the frictional force on the tube jacket.

Experience has shown that also in the case of loose soils, the smooth auger helix surface can give rise to difficulties during the vertical transportation of the soil. It is also very difficult to rotate the auger with respect to the encasing tube.

The principle of the invention is based on the fact that the roughness of the surface of the auger helix 2 is increased compared with the roughness of the rolled plates and the increased surface roughness occurs over the entire auger length necessary for delivering soil. The increase in the surface roughness has different effects.

As a result of the higher surface roughness of the helix surface, the contact space between soil and helix is smaller with cohesive soils. Contact takes place in punctiform manner or at least in small area form. Therefore the adhesion forces between soil and helix surface are much lower than with smooth helix surfaces. As a result the soil sticks or adheres less firmly to the helix surface. This avoids blockages on the auger and continuous feed or delivery is possible.

Also in the case of loose soils, as a result of the changed surface characteristics there is a clear improvement to the delivery behaviour. The auger rotates much more easily in the tube and the soil to be delivered can be more rapidly and easily brought upwards. This effect has been proved in numerous tests.

BRIEF DESCRIPTION OF THE SEVERAL VIEW OF THE DRAWINGS

DETAILED DESCRIPTION OF THE INVENTION

Embodiments of the device according to the invention are shown in FIGS. 1 to 4.

Figure 1:
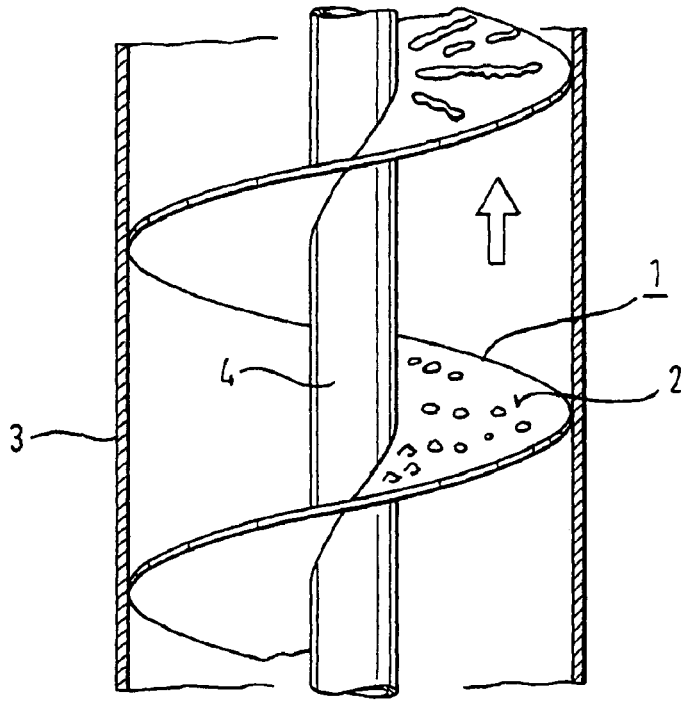
FIG. 1 is a section through the boring tool of a double head boring appliance.

FIG. 1 is a section through the boring tool of a double head boring appliance. A rotary encasing tube 3 contains a continuous soil auger with a core tube 4, a helix 1 and a helix surface 2 directed upwards in the delivery direction. Prominences and depressions are applied to the helix surface directed in the feed direction.

Figure 2A:
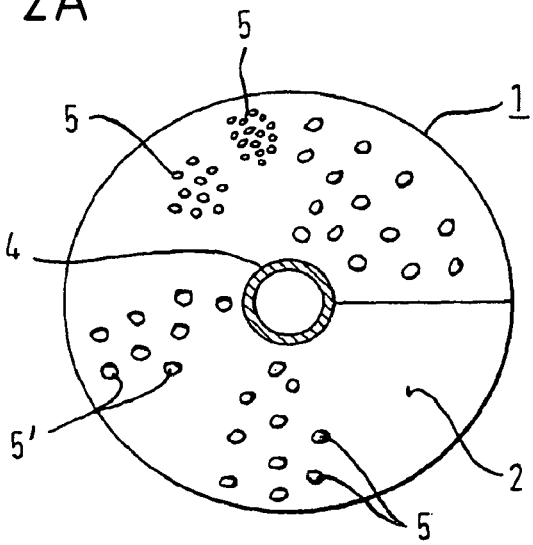
FIGS. 2A and 2B are respectively a plan view of a first embodiment of a helix and to the right thereof a section through the auger helix.
Figure 2B:
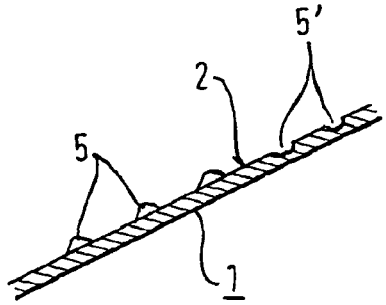

FIGS. 2A and 2B respectively show in an embodiment a plan view of a helix 1 and to the right thereof a section through the auger helix. This is an embodiment with punctiform prominences 5 and depressions 5' arranged on the side of the auger helix face 2 directed in the auger feed direction.

Figure 3A:
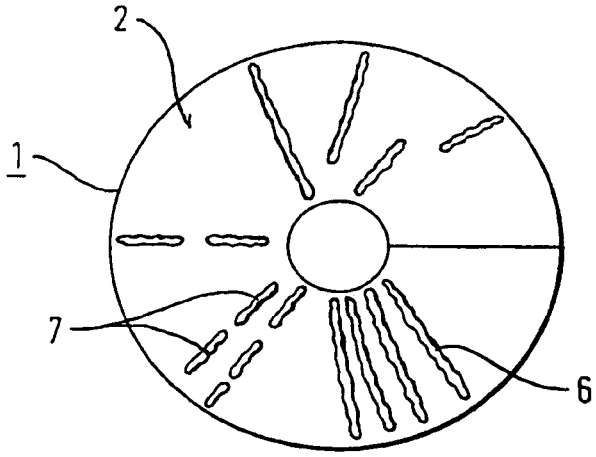
FIGS. 3A and 3B are respectively a plan view of a second embodiment of a helix and a section through the auger helix.
Figure 3B:
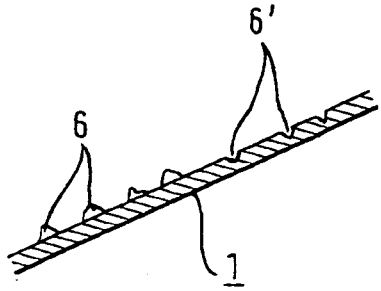

FIGS. 3A and 3B respectively show in another embodiment a plan view and a section through the auger helix of an inventive device. In this case the prominences 6, 7 and depressions 6' are linear, namely in the form of continuous lines and broken lines, said lines being substantially rectilinear.

Figure 4:
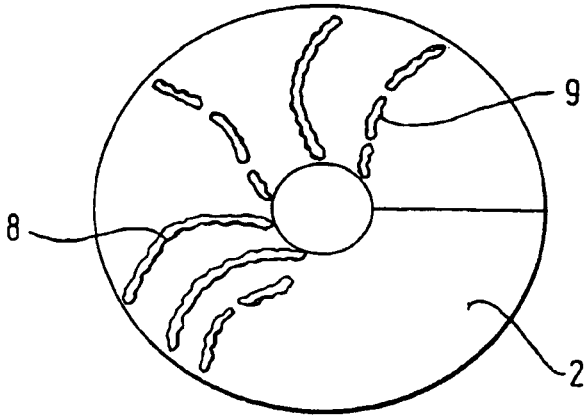
FIG. 4 is a plan view of a third embodiment of a helix.

FIG. 4 shows an embodiment where the prominences and depressions 8, 9 are arranged in curved lines and in continuous and interrupted form.

The auger body generally comprises a core tube 4 and auger helixes 1 made from rolled plates. The increase in the surface roughness is appropriately only implemented on the side of the auger helix surface 2 pointing in the desired delivery or feed direction.

The roughness increase is preferably subsequently produced on the auger helix surface, because experience has shown that it must be frequently repeated as a result of wear.

The greater roughness can e.g. comprise a larger number of punctiform prominences 5, which can e.g. be made by weld surfacing. The arrangement of the welding spots can be distributed differently over the auger surface 2. For this purpose there can be a full-area distribution or a distribution over partial areas. The mutual spacings of the prominences can be uniform or irregular. The spacings between the individual prominences are dependent on the grain size of the soil and the soil requirements and preferably vary between 1/10 mm and 10 cm. The size of the prominences 5 is preferably in a range between 1/10 mm and 5 cm.

The roughness differences can also be produced in such a way that depressions 5' are made on the helix surface 2 in place of prominences.

For the arrangement and dimensions of said depressions 5', the same possibilities exist as for the prominences 5. The production of the depressions 5' preferably takes place by pressing or rolling, punching the surface, stamping, drilling or burning off.

Another variant for the prominences 5 consists of them being applied by firing steel particles in non-positive manner onto the helix surface at high speed using a suitable apparatus. This procedure is known from the prior art concerning firing dowels.

Apart from punctiform prominences, it can be appropriate to arrange the prominences or depressions in lines 6. It can also be appropriate in order to save material to have the lines in interrupted form 7. The roughness is also determined by the spacing of said linear prominences. These spacings are in the range between a few millimetres and a few centimetres. Linear application preferably takes place by weld surfacing using weld beads. For this purpose use can be made of highly wear resistant welding electrodes or welding rods.

Besides linear prominences, there are also linear depressions 6', which are appropriately produced by the burning method, the rolling method or by machining.

According to another variant, the linearly applied surface roughness is applied in curved and not straight line forms 8, 9. It is important that the lines on the helix are essentially at right angles to the auger feed direction, i.e. run from the core tube towards the helix edge or towards the inside of the encasing tube 3.

According to another variant for increasing surface roughness, the punctiform prominences of the helix surface 2 are formed in that substantially circular or angular grains of wear-resistant material are connected non-positively to the surface by means of an adhesive matrix. Application can take place using prior art spraying methods or by flame spraying.

In the case of surface coating, the particle sizes are preferably in the range 1/10 mm to a few millimetres (below 10 mm). The spacing of the individual particles can, as for abrasive papers, be very small or larger spacings can be adopted, this being dependent on the grain size of the soil to be fed. The spacings of the particles or grains are preferably in the range 1/10 mm to a few millimetres (below 10 mm). Standard plastics or liquefied metals are used for the adhesive matrix.

For the grains are e.g. used metals and metal compounds, corundum, carbides, carbon compounds and mineral rocks. The materials are known from the field of abrasives and abrasive papers. Preferably said grains are obtained from so-called hard materials, which are characterized by a high wear resistance. A very high grade construction results from coating with industrial diamonds.

The roughening of the smooth plate surface can also take place that the plate surfaces 2 directed in the delivery or feed directions are worked by sandblasting or comparable methods. Preferably height differences in the helix surface 2 of 0.1 mm to lower than 5 mm are obtained.

What is claimed is:

1. A device for use in a rotary boring procedure to produce bored piles in the ground, the device comprising:

an auger of predetermined length and rotating in a first direction during the boring procedure;

an encasing tube surrounding at least a portion of the length of the auger and rotating in a second direction during the boring procedure;

the auger and the encasing tube being essentially vertically introduced essentially simultaneously into the ground during the boring procedure, the direction of introduction into the ground defining a feed direction;

a helix forming part of the auger, the helix having a helix surface pointing in the feed direction; and means for increasing the roughness of the helix surface in the feed direction for facilitating material discharge, the increased surface roughness extending over a portion of the auger length needed for feed purposes, wherein the increased surface roughness takes place by full or partial-surface coating of at least the helix surface directed in the feed direction, circular or angular grains of wear-resistant material being non-positively connected to the auger helix surface by means of an adhesive matrix.

2. Device according to claim 1, wherein the grains are metal, carbon compounds, carbides, corundum and minerals, or other hard materials.

3. The device according to claim 1, wherein the first and second directions are the same.

4. The device according to claim 1, wherein the first direction is opposite to the second direction.

5. The device according to claim 1, wherein the helix is produced from rolled plates.

6. A device for use in a rotary boring procedure to produce bored piles in the ground, the device comprising:

an auger of predetermined length and rotating in a first direction during the boring procedure;

an encasing tube surrounding at least a portion of the length of the auger and rotating in a second direction during the boring procedure;

the auger and the encasing tube being essentially vertically introduced essentially simultaneously into the around during the boring procedure, the direction of introduction into the ground defining a feed direction;

a helix forming part of the auger, the helix having helix surface pointing in the feed direction; and means for increasing the roughness of the helix surface in the feed direction for facilitating material discharge, the increased surface roughness extending over a portion of the auger length needed for feed purposes, wherein increased surface roughness is brought about by sandblasting.

7. The device according to claim 6, wherein the first and second directions are the same.

8. The device according to claim 6, wherein the first direction is opposite to the second direction.

9. The device according to claim 6, wherein the helix is produced from rolled plates.

10. A device for use in a rotary boring procedure to produce bored piles in the ground, the device comprising:

an auger of predetermined length and rotating in a first direction during the boring procedure, the auger having a core tube;

an encasing tube surrounding at least a portion of the length of the auger and rotating in a second direction during the boring procedure;

the auger and the encasing tube being essentially vertically introduced essentially simultaneously into the ground during the boring procedure, the direction of introduction into the ground defining a feed direction;

a helix forming part of the auger, the helix having a helix surface pointing in the feed direction and an outer edge; and means for increasing the roughness of the helix surface in the feed direction, the increased surface roughness extending over a portion of the auger length needed for feed purposes, wherein the surface roughness is obtained by at least one of essentially linear prominences and depressions, the linear prominences and depressions essentially passing from the core tube to the outer edge of the auger helix.

11. Device according to claim 10, wherein the linear prominences and depressions are at least one of essentially continuous and interrupted.

* * * * *